United States Patent [19]

Eibe

[11] 4,000,635

[45] Jan. 4, 1977

[54] STRIP DEFLECTOR UNIT

[75] Inventor: Werner W. Eibe, McCandless Township, Allegheny County, PA

[73] Assignee: Blaw-Knox Foundry & Mill Machinery, Inc., Pittsburgh, Pa.

[22] Filed: Mar. 18, 1976

[21] Appl. No.: 668,059

[52] U.S. Cl. ..... 72/148; 242/80

[51] Int. Cl.[2] ..... B21C 47/04; B21C 47/14

[58] Field of Search .... 72/146, 148, 166, 169–174, 72/251; 242/78, 78.1, 79, 80

[56] References Cited

UNITED STATES PATENTS

| | | | |
|---|---|---|---|
| 1,977,214 | 10/1934 | Steckel | 242/78.1 |
| 2,200,656 | 5/1940 | Schefe | 242/80 |
| 2,449,234 | 9/1948 | Knoble | 242/80 |
| 3,112,087 | 11/1963 | Fornataro | 72/166 |
| 3,304,023 | 2/1967 | O'Brien | 242/80 |
| 3,328,990 | 7/1967 | Sieger et al. | 72/148 |
| 3,368,378 | 2/1968 | O'Brien | 72/148 |
| 3,818,737 | 6/1974 | Kajiwara et al. | 72/148 |
| 3,913,367 | 10/1975 | Galletti | 72/148 |

*Primary Examiner*—C.W. Lanham
*Assistant Examiner*—E. M. Combs
*Attorney, Agent, or Firm*—Buell, Blenko & Ziesenheim

[57] ABSTRACT

The apparatus comprises a deflector roll over which the strip travels positioned above a downcoiler, an endless belt traveling just above the strip over the deflector roll, and two movable persuader rolls positioned within the belt loop. One roll is positioned beyond the deflector roll and, when depressed, wraps the lower flight of the belt and the leading end of the strip around an arc of the deflector roll so as to direct the strip end into the coiler entry. The other roll is positioned before the deflector roll and, when depressed, wraps the lower flight of the belt and the strip end around an arc of the persuader roll and up over the deflector roll so as to direct the strip end over the coiler entry.

11 Claims, 7 Drawing Figures

STRIP DEFLECTOR UNIT

Figure 1:
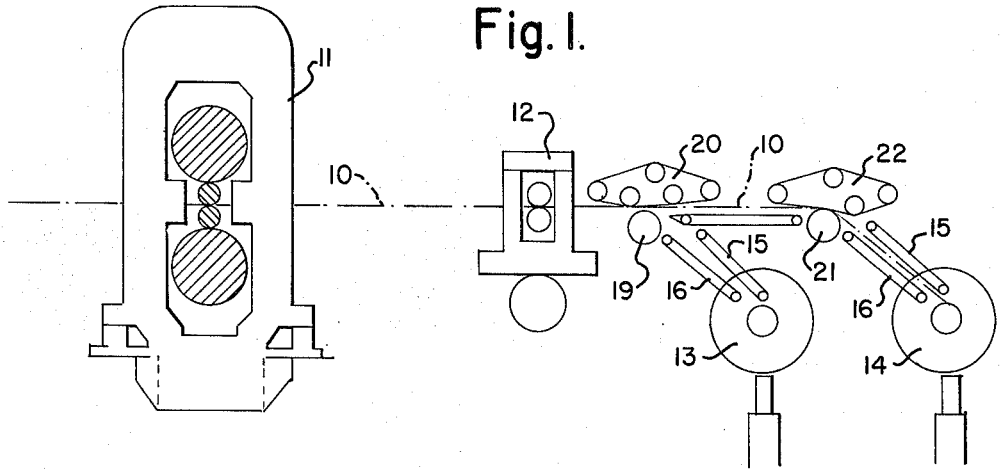

This invention relates to the coiling of continuously cold-rolled metal strip. It is more particularly concerned with apparatus and process for directing the leading end of thin cold-rolled strip leaving a tandem mill into a downcoiler, or over a preceding downcoiler into a succeeding downcoiler.

In the continuous cold-rolling of metal strip in a tandem mill, the material is passed through a succession of roll stands to reduce it to the desired gauge, and is coiled after it leaves the last stand. It is inefficient to stop a tandem mill to remove a full coil of strip from the coiler, and such mills are conventionally provided with a shear following the last stand and two or more coilers, one behind the other. The mill is slowed down when one coiler is full, the strip is sheared, and the new leading end is directed into an empty coiler. Some mechanism is necessary to direct the leading end of the strip, into the empty coiler and to bridge the full coiler if it is nearer the mill.

When the coilers are downcoilers, which is usual, that operation is usually carried out by a roll normally positioned slightly above the pass line of the strip at the entry end of the coiler which may be provided with a movable gate. The roll is mounted so that it can be depressed below the pass line to direct the new leading end of the strip into the coiler or left in its raised position to allow the new leading end of the strip to pass over the coiler to a following coiler. Apparatus of this type is generally satisfactory for metal of strip or sheet gauges, but for thinner material, for example, steel of tin plate gauges, which go down to .007 inch, devices of this sort may give trouble. The thinner material necessarily leaves the mill at higher speeds than metal in sheet gauges and the added cold work imparted to the strip in its greater reduction of thickness renders it springy. Moreover, at strip speeds well below the strip delivery speeds of modern tandem cold mills this strip tends to become airborne. That new leading end, therefore, does not necessarily lie flat on the pass line.

It is the principal object of my invention to provide strip deflection apparatus which is capable of handling thin, springy cold-rolled metal strip delivered at high speeds, as well as conventional metal of sheet gauges. It is another object to provide such apparatus which, when associated with a downcoiler which is not the last coiler, imparts an upward curl to the leading end of the strip destined for a succeeding downcoiler, so as to insure that that leading end jumps the gap over the preceeding coiler. It is still another object to provide such apparatus which, when associated with a succeeding downcoiler, accepts a leading end with an upward curl and guides it into that coiler. Other objects of my invention will become evident from the description thereof which follows.

My apparatus, as associated with a downcoiler which is not the terminal coiler, comprises a deflector roll tangent to the lower surface of the strip pass line and positioned in advance of the coiler, a pair of rolls positioned above the pass line, one in advance of the deflector roll and one behind it, a belt trained around those rolls, a tension roll positioned inside the belt, two additional rolls positioned inside the belt, one in advance and one behind the deflector roll, and means for selectively depressing each of the additional rolls to depress the lower flight of the belt beneath that additional roll below the strip pass line. One belt roll and the deflector roll are driven.

My apparatus as associated with a terminal downcoiler is as above described, but without the additional roll positioned between the deflector roll and the belt roll ahead of it.

Figure 3:
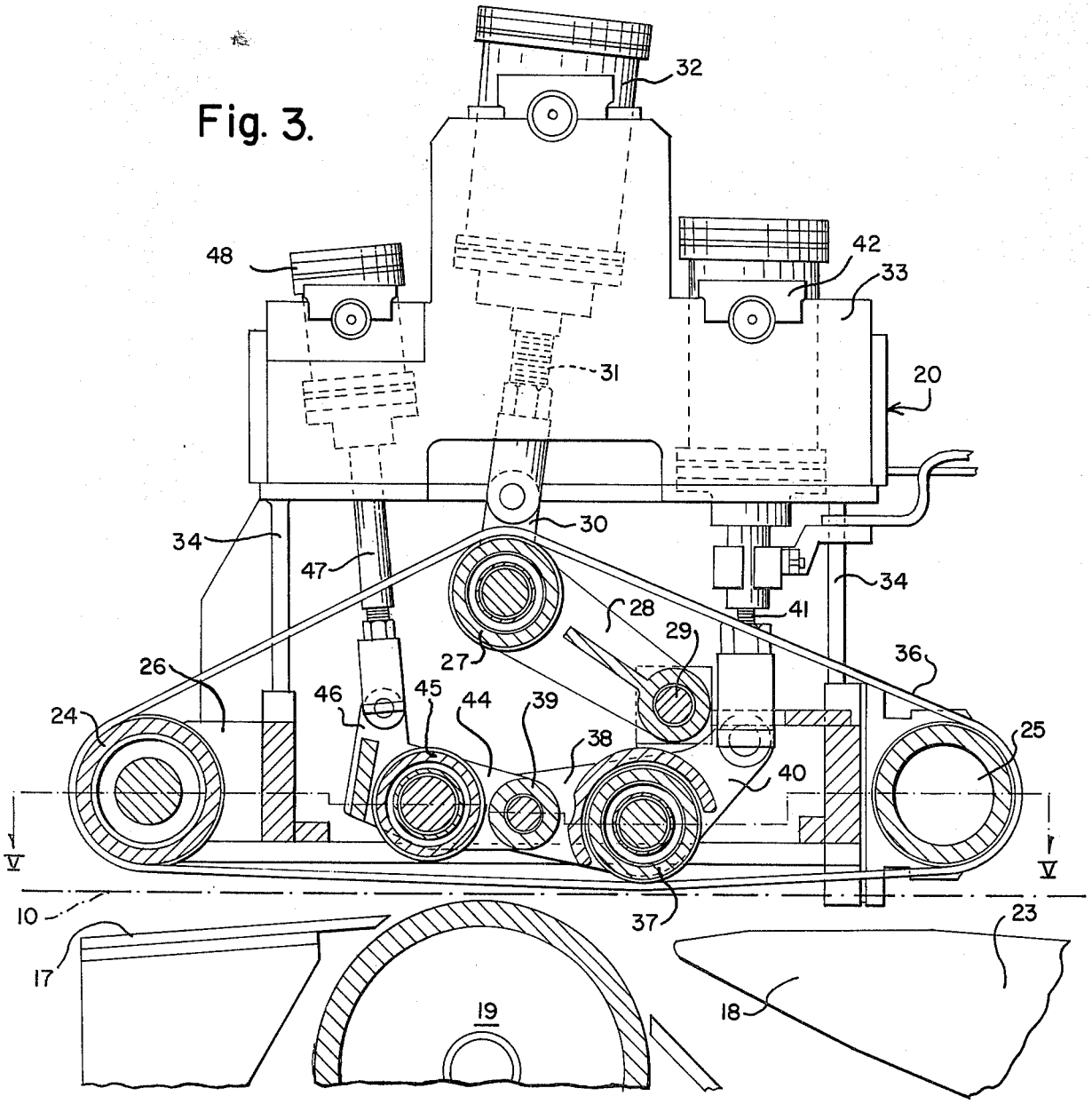
Figure 2:
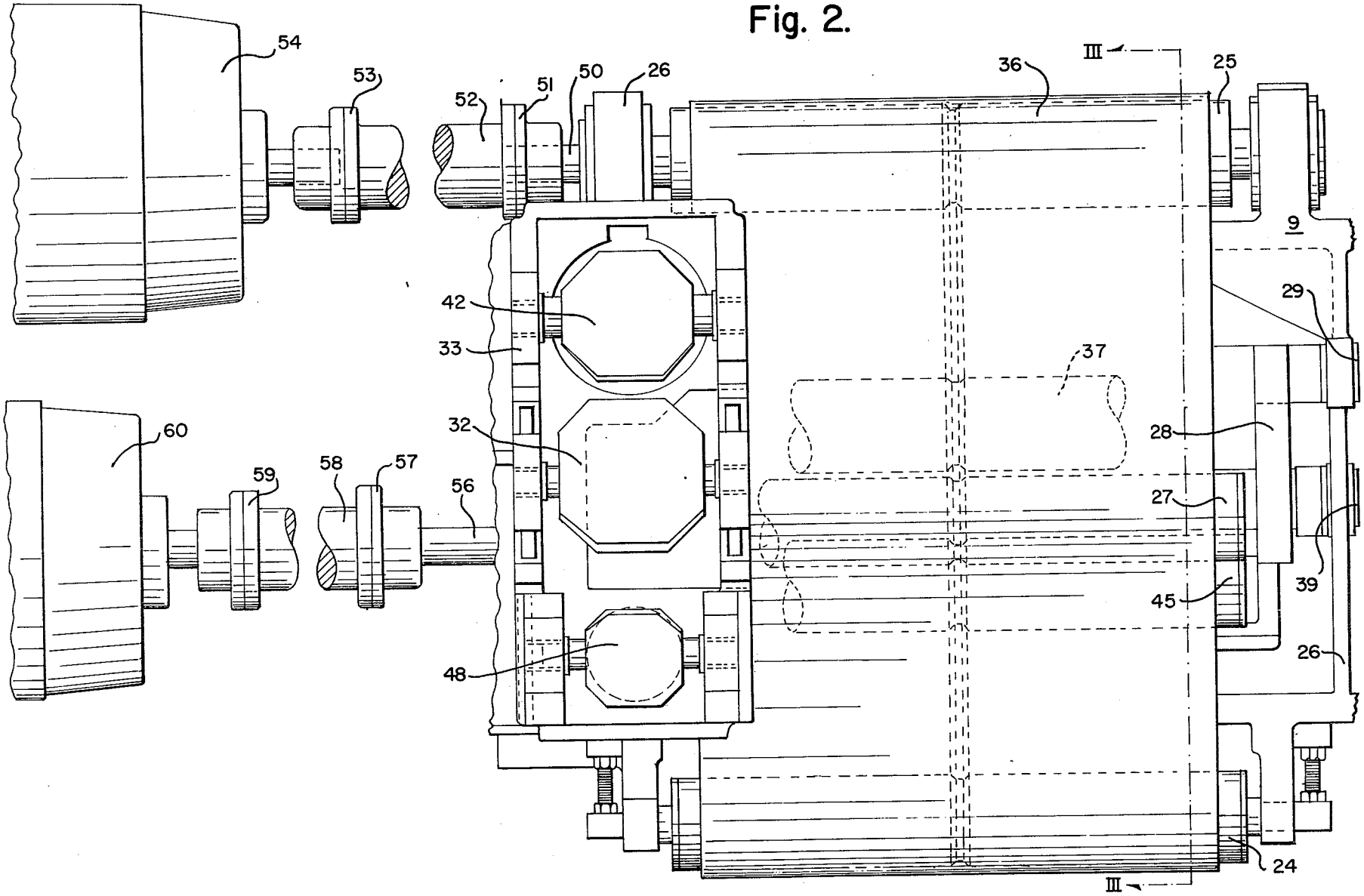
Figure 4:
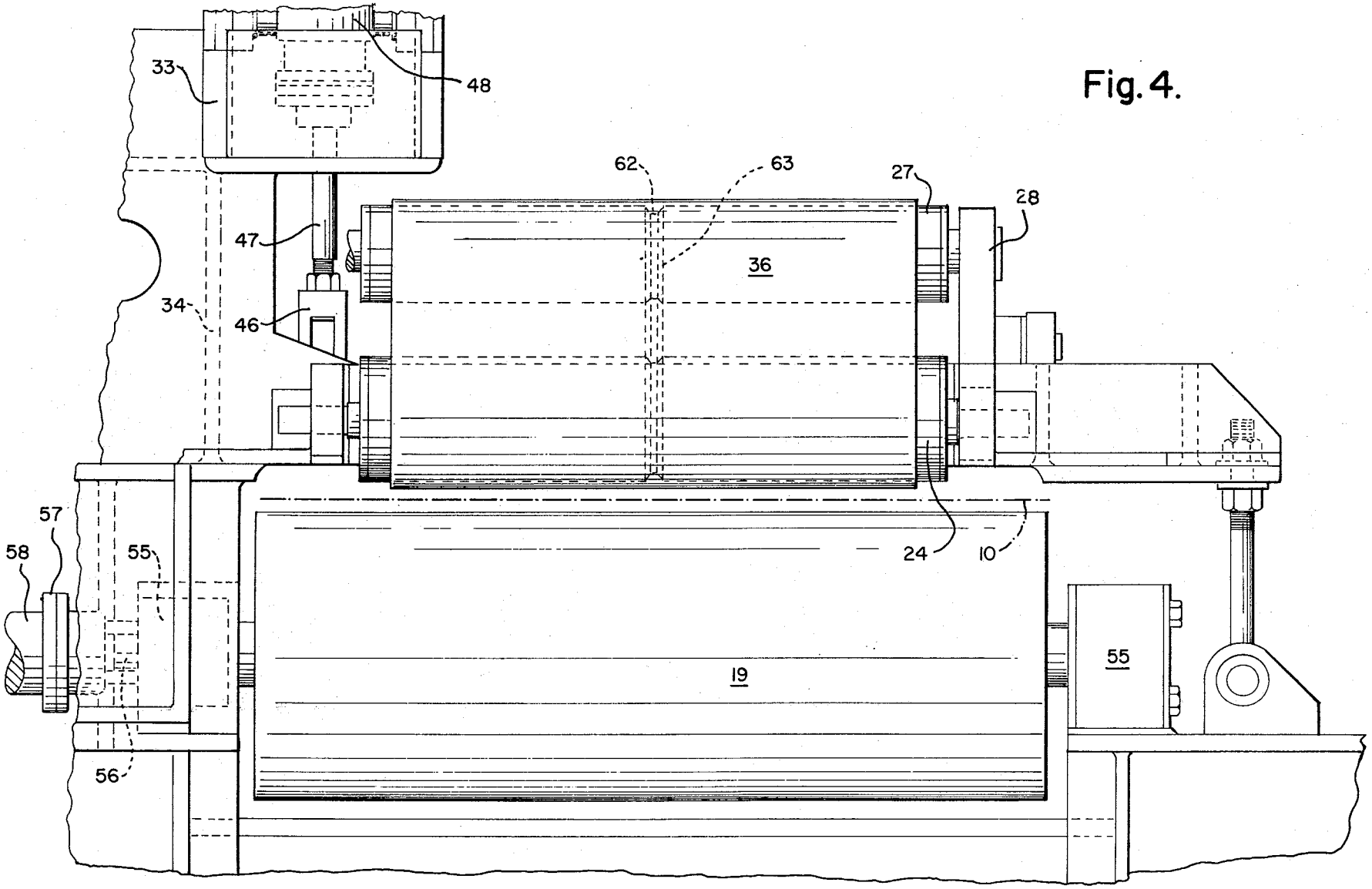
Figure 5:
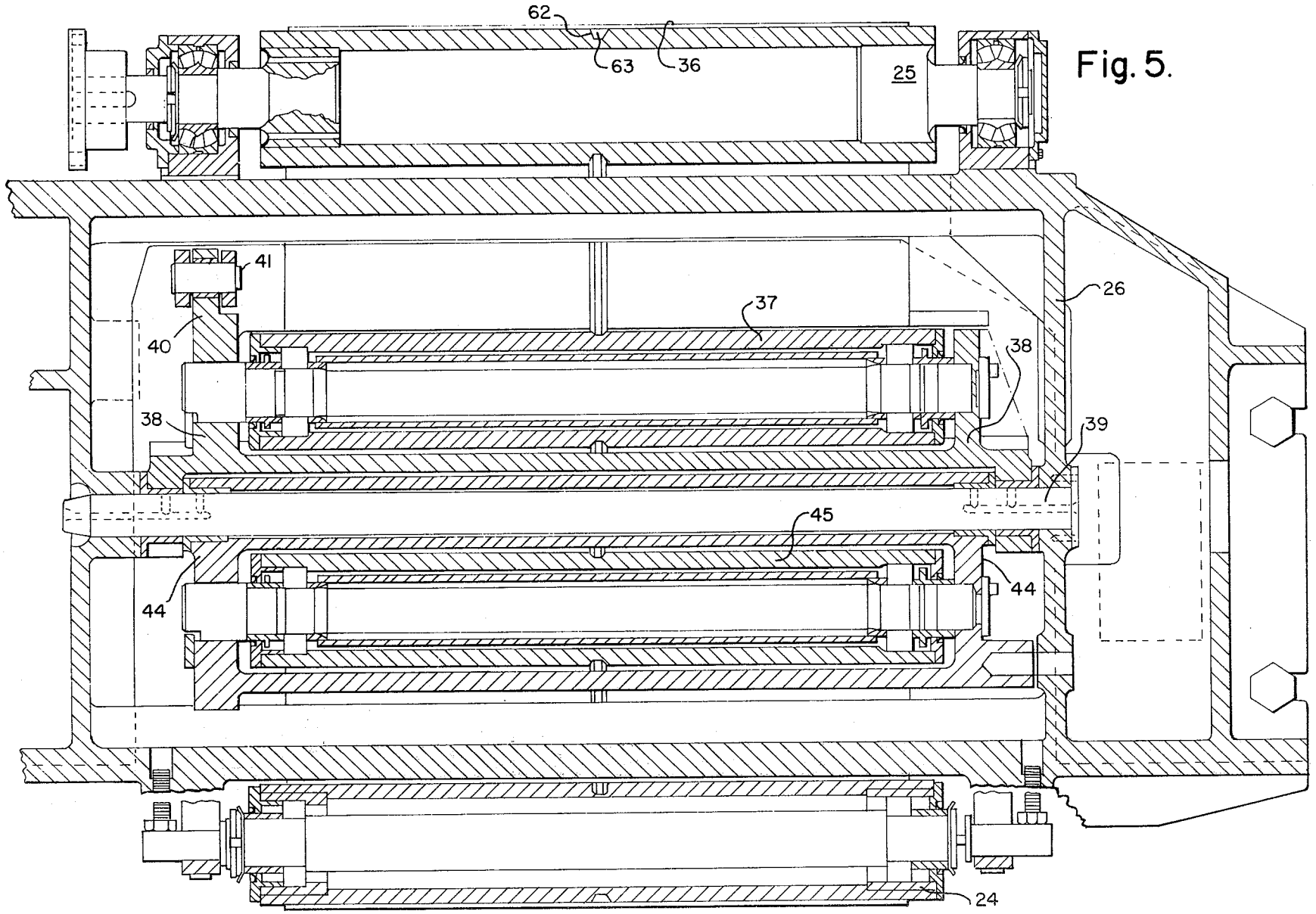
Figure 6:
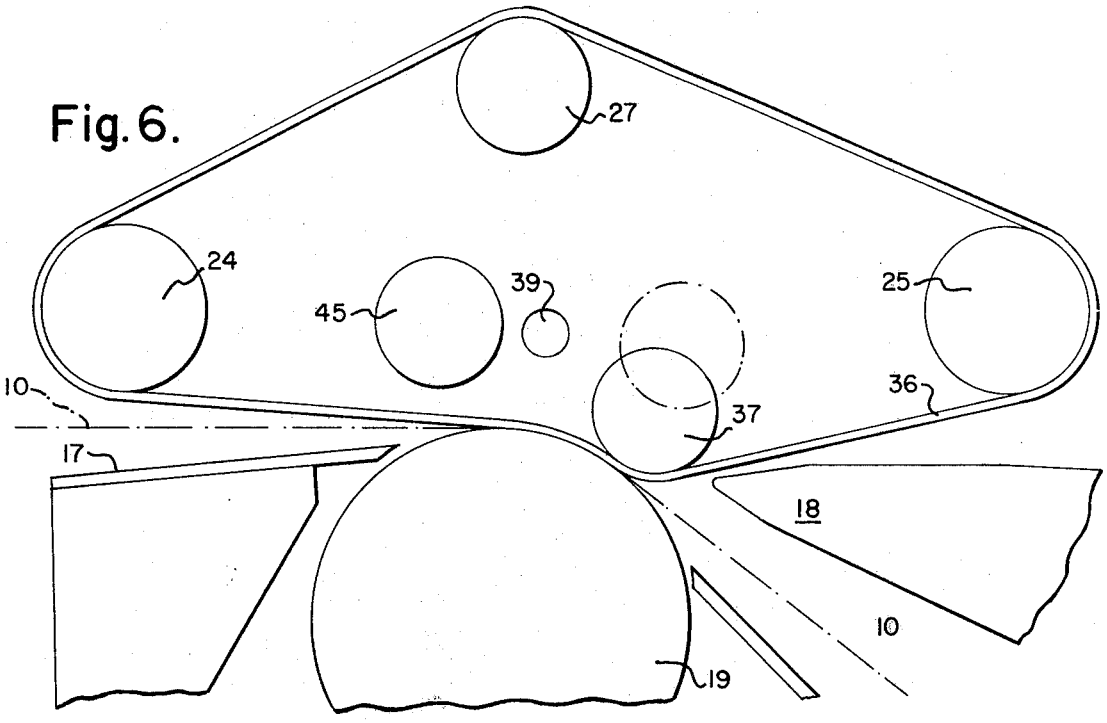
Figure 7:
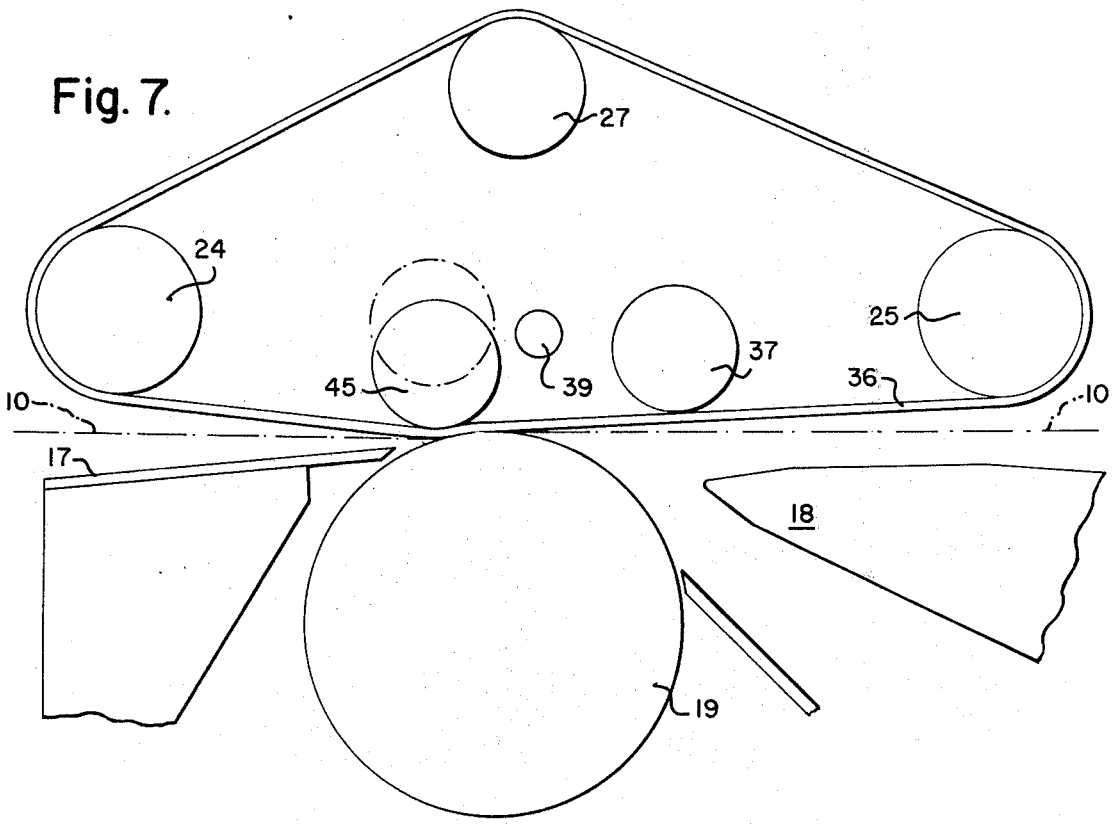

An embodiment of my apparatus presently preferred by me is illustrated in the accompanying figures to which reference is now made:

FIG. 1 is a schematic elevation of the delivery end of a tandem cold strip mill embodying my invention, FIG. 2 is a plan of the apparatus of my invention, FIG. 3 is a cross-section taken on the plane III—III of FIG. 2 of the apparatus of my invention, FIG. 4 is a partial end elevation of the apparatus of FIG. 2, FIG. 5 is a horizontal cross section of a portion of my apparatus taken on the broken plane V—V of FIG. 3, FIG. 6 is a diagrammatic representation of my apparatus as shown in FIG. 3, but in position to deflect strip to a coiler below it, and FIG. 7 is a diagrammatic representation of my apparatus as shown in FIG. 3, but in position to deflect strip to bridge the coiler below it.

In FIG. 1, the strip 10 is delivered from the last stand 11 of a tandem cold-strip mill. The strip may pass through a bridle or other tensioning means not shown, and is lead through a rotary shear 12. Spaced from the exit end of the shear 12 and below the pass line of the strip 10 are first downcoiler 13 and second downcoiler 14, respectively, of conventional construction, the second behind the first. Below the pass line of strip 10 and tangent thereto a deflector roll 19 is positioned between shear 12 and coiler 13. Coiler 13 is provided with upper and lower strip guide means 15 and 16 respectively, positioned to guide strip from the deflector roll 19 into coiler 13. A second deflector roll 21 also is positioned below the pass line of the strip 10 and tangent thereto, in the same position relative to downcoiler 14 as is roll 19 to downcoiler 13. Coiler 14 is likewise provided with upper and lower strip guides 15 and 16 respectively. Those guide means may be conveyor belt means. Immediately above deflector roll 19 is positioned a strip deflector unit 20 to be described, and immediately above deflector roll 21 is positioned a deflector unit 22, also to be described.

Deflector unit 20 is positioned immediately following shear 12. A lower entry guide 17 is fixed between shear 12 and deflector roll 19, which roll is mounted in bearings 55 affixed to a foundation (FIG. 4). Guide 17 comprises a flat table fixed below the strip pass line and sloping upwardly from its entry end at shear 12 to its discharge end just short of the surface of deflector roll 19 (FIG. 3). An exit guide 23 is positioned below the strip pass line following deflector roll 19 and extending to deflector roll 21. The major portion of guide 23 is a belt conveyor but its forward end is a wedge-shaped divider plate 18 with its thin edge toward deflector roll 19 but separated therefrom. When the strip is to be coiled in coiler 13, its leading end is directed downwardly into the gap between deflector roll 19 and divider plate 18, but when the strip is to be coiled in coiler 14 its leading end is directed over the upper surface of divider plate 18 to guide 23.

Deflector unit 20 is positioned above the pass line and extends beyond the entry and exit sides of deflector roll 19 over guides 17 and 23, respectively. At the entry end of its frame 26 is journaled an idler belt training roll 24, and at the exit end is journaled a driven belt training roll 25. Rolls 24 and 25 are of the same diameter. An idler roll 27 is journaled in a pair of crank arms 28 forming a clevis pivotally mounted at their other ends in frame 26 on a transverse shaft 29 intermediate belt training rollers 24 and 25. A rectangular superstructure 33 is supported above frame 26 by standards 34 at each end, and in that superstructure a preferably air or hydraulic cylinder 32 is pivotally mounted with its piston rod 31 connected to arm 30 which is an extension of a crank arm 28. Around rolls 24, 25 and 27 is trained a belt 36.

Between belt training rolls 24 and 25 and intermediate roll 25 and deflector roll 19 is positioned a persuader roll 37 journaled in a pair of crank arms 38 which form a clevis and are pivotally mounted at their other ends in frame 26 on transverse shaft 39. That shaft is on the exit side of the axis of deflector roll 19. An extended arm 40 is affixed at one end to an arm 38 and is connected at its other end to piston rod 41 of preferably air or hydraulic cylinder 42, which is also mounted in superstructure 33. A second pair of crank arms 44 is likewise pivotally mounted at one end in frame 26, likewise on shaft 39. In the other end of those arms, which also form a clevis, is journaled a second persuader roll 45 with its axis on the entry side of the axis of deflector roll 19. The spacing of persuader roll 37 from the vertical plane of axis of deflector roll 19 is greater than the spacing of persuader roll 45 from that plane. An extended arm 46 is affixed at one end to an arm 44, and is connected at its other end to the piston rod 47 of preferably air or hydraulic cylinder 48 which is also mounted in superstructure 33. Arms 38 are longer than arms 44.

Belt training roll 25 is provided with a shaft 50 which extends at one end beyond the roll bearing in frame 26, (FIG. 2). Roll shaft 50 is connected through a flexible coupling 51 to a drive shaft 52, the other end of which is connected through a second flexible coupling 53 to a drive motor 54. Deflector roll 19 is likewise provided with a shaft 56 which extends at one end beyond the roll bearings 55, (FIG. 4). Roll shaft 56 is connected through a flexible coupling 57 to a drive shaft 58, the other end of which is connected through a second flexible coupling 59 to a drive motor 60. Motors 54 and 60 drive their rolls at peripheral speed equal to that of the strip.

Belt training rolls 24 and 25, tension roll 27 and persuader rolls 37 and 45 are each formed with a circumferential flat-bottomed V-groove 62 intermediate their ends, and belt 36 is formed with a mating rib 63 projecting from its underside which runs in the V-grooves of the rolls and serves to keep the belt in alignment with those rolls (FIG. 5).

The operation of deflector unit 20 will be described with particular reference to FIGS. 6 and 7, and the foregoing description of the apparatus. Deflector roll 19 is rotated by its drive motor 60, and belt 36 is made to travel around belt training rolls 24 and 25 and tension roll 27 by the rotation of belt training roll 25 which is driven by motor 54. Persuader rolls 37 and 45 are normally held at positions such that the lower flight of belt 36 is more or less parallel with the pass line of the strip, but spaced above it (FIG. 3). When it is desired to direct a leading end of strip into coiler 13, persuader roll 37 is lowered by admitting air or hydraulic fluid into the upper end of cylinder 42. Piston rod 41 is forced downwardly, moving arm 40 and crank arms 38 downwardly about pivot shaft 39, and so carrying persuader roll 37 downwardly against the lower flight of belt 36. Persuader roll 37 is depressed sufficiently to wrap belt 36 around a small arc of the surface of deflector roll 19 on the delivery side of its axis (FIG. 6). After that small arc has been preformed the strip is cut by rotary shear 12. The leading end of the cut strip is guided into the bight so formed, and curled downwardly therein so as to pass between deflector roll 19 and divider plate 18 into guides 15 and 16 of coiler 13. After the coil is started, persuader roll 37 is raised to its initial position.

When it is desired to pass the leading end of the strip over coiler 13 to coiler 14, air or hydraulic fluid is admitted to the upper end of cylinder 48 causing piston 47 to move downwardly and swing arm 46 and crank arms 44 downwardly around their pivot shaft 39, carrying persuader roll 45 against the lower flight of belt 36. As the axis of roll 45 is ahead of the plane of the axis of deflector roll 19, the belt 36 is wrapped around a small arc on the underside of roll 45 and after leaving that roll inclines upwardly to roll 25 with no substantial reverse curve over the top of roll 19 (FIG. 7). After that small arc has been preformed the strip is cut by rotary shear 12. The leading end of the strip is guided into the bight so formed and curled upwardly therein, which insures that it will jumped the gap between deflector roll 19 and divider plate 18 and be carried to coiler 14 by guiding means 23.

Deflector unit 22 is required only to introduce the leading end of the strip into the guides 15 and 16 of downcoiler 14. It differs from deflector unit 20 previously described herein only in omitting persuader roll 45, its mounting 44, and actuating mechanism, cylinder 48, piston rod 47 and arm 46. It is positioned above deflector roll 21 in the same way that deflector unit 20 is positioned above deflector roll 19. The operation of deflector unit 22 is the same as the operation of the corresponding portion of deflector 20 which has been described. The entry end belt training roll of deflector unit 22 corresponding to roll 24 of deflector unit 20 is spaced above the strip pass line a distance sufficient to accept a strip leading end with the upward curl imparted to it by preceding deflector unit 20, and that curl is neutralized by the reverse bend imparted to the strip end as it passes through the bight formed by deflector roll 21 and the belt wrapped around the portion of the surface of deflector roll 21 by the persuader roll corresponding to roll 37 of deflector unit 20.

In the foregoing specification I have described presently preferred embodiments of my invention; however, it will be understood that my invention can be otherwise embodied within the scope of the following claims.

I claim:

1. Apparatus for directing traveling metal strip along a pass line with respect to a downcoiler comprising a deflector roll positioned below the pass line of the strip tangent thereto, a pair of belt training rolls positioned above the pass line and spaced therefrom, the first belt training roll being positioned in advance of the deflector roll and the second belt training roll being positioned on the exit side of the deflector roll, a belt trained around the first and second belt training rolls in a loop and having a lower flight extending between the first and second belt training rolls, means for tensioning the belt, a persuader roll positioned within the belt loop intermediate the deflector roll and the second belt training roll, said persuader roll being mounted for vertical movement, means for causing the belt to travel around the belt training rolls, means for rotating the deflector roll, and means for moving the persuader roll downwardly to depress below the pass line and around a portion of the deflector roll surface the lower flight of the belt trained around that roll, thereby imparting a downward curl to the leading end of strip passing thereunder and over the deflector roll so as to direct it into the downcoiler.

2. Apparatus of claim 1 in which the deflector roll is of greater diameter than the persuader roll.

3. Apparatus of claim 1 in which the means for tensioning the belt comprise a tension roll positioned intermediate the first and second belt training rolls and above them, and means for urging the tension roll upwardly.

4. Apparatus of claim 1 including a second persuader roll positioned within the belt loop intermediate the deflector roll and the first belt training roll, mounted for vertical movement, means for moving the second persuader roll downwardly to depress the lower flight of the belt below the pass line and around a portion of the persuader roll surface, thereby imparting an upward curl to the leading end of the strip passing therearound and over the deflector roll, whereby the leading end bypasses the downcoiler.

5. Apparatus of claim 4 in which the first and second persuader rolls are of the same diameter.

6. Apparatus of claim 4 in which the spacing between the second persuader roll and the vertical plane of the axis of the deflector roll is less than that between the first persuader roll and that plane.

7. Apparatus of claim 4 in which the deflector roll is of greater diameter than the second persuader roll.

8. Apparatus of claim 4 in which each persuader roll is carried in a pair of cranks pivoted about a horizontal axis.

9. Apparatus of claim 8 in which the axis of the cranks is positioned on the side of the deflector roll from which the strip recedes.

10. Apparatus of claim 8 in which the cranks for both persuader rolls are pivoted on the same horizontal axis intermediate those rolls.

11. Apparatus of claim 8 in which the length of the cranks carrying the first persuader roll is greater than that of the cranks carrying the second persuader roll.

* * * * *